US006642659B1

(12) United States Patent
Hsieh

(10) Patent No.: US 6,642,659 B1
(45) Date of Patent: Nov. 4, 2003

(54) STAND LAMP ASSEMBLY INCLUDING MAIN AND AUXILIARY LAMP UNITS

(76) Inventor: Duan-Cheng Hsieh, 2F, No. 218, Lane 78, Huai-Te St., Pei-Tou Dist., Taipei City (TW)

( * ) Notice: Subject to any disclaimer, the term of this patent is extended or adjusted under 35 U.S.C. 154(b) by 0 days.

(21) Appl. No.: 10/194,611

(22) Filed: Jul. 12, 2002

(51) Int. Cl.[7] ..... H01J 13/46; F21V 21/29

(52) U.S. Cl. ..... 315/56; 315/149; 362/276; 362/257; 362/802

(58) Field of Search ..... 315/56, 57, 58, 315/149, 158, 157, 152; 362/276, 257, 410, 802, 806

(56) References Cited

U.S. PATENT DOCUMENTS 6,400,104 B1 * 6/2002 Ham, II ..... 315/312
6,476,559 B2 * 11/2002 Rapp ..... 315/88
2003/0007360 A1 * 1/2003 Hsieh ..... 362/411

* cited by examiner

*Primary Examiner*—Don Wong
*Assistant Examiner*—Tuyet T. Vo
(74) *Attorney, Agent, or Firm*—Townsend and Townsend and Crew LLP

(57) ABSTRACT

A stand lamp assembly includes a stand frame unit and auxiliary and main lamp units. The auxiliary lamp unit includes a night lamp disposed removably on a night lamp socket, a light sensor to control activation of the night lamp in accordance with ambient light conditions, and a sleeve disposed around the night lamp and having a rotatable cover body that can be opened to permit removal of the night lamp via an opening in the sleeve.

7 Claims, 6 Drawing Sheets

STAND LAMP ASSEMBLY INCLUDING MAIN AND AUXILIARY LAMP UNITS

BACKGROUND OF THE INVENTION

1. Field of the Invention

The invention relates to a stand lamp assembly, more particularly to a stand lamp assembly that includes main and auxiliary lamp units.

2. Description of the Related Art

Referring to FIGS. 1 and 2, a conventional stand lamp assembly 900 is shown to comprise a power control circuit 91, a stand base 92, a hollow upright stand body 93, an auxiliary lamp unit 94, a main lamp unit 95, an annular skirt member 96, and a lampshade 97. The power control circuit 91 includes a power cord 911 and a wire unit 912 that extends outwardly from a center hole 921 in the stand base 92 to connect with the main lamp unit 95. The stand body 93 has a lower portion 931 engaged threadedly to the center hole 921 in the stand base 92. A power switch 933 is connected to the control circuit 91 so as to control activation of the main lamp unit 95. The auxiliary lamp unit 94 includes an upright frame member 943, a tubular sleeve 944, a night lamp 942, and a light sensor 941. The upright frame member 943 has a lower section engaged to an upper portion of the stand body 93 by means of a connector 934, a left side formed with a hollow post 9431 for extension of the wire unit 912 therethrough, and a right side formed with a night lamp socket 9432. The tubular sleeve 944 is sleeved on the upright frame member 943. The night lamp 942 is mounted on the night lamp socket 9432 of the frame member 943. The light sensor 941 is connected to the night lamp 942 and the power control circuit 91 so as to control activation of the night lamp 942 in accordance with ambient light conditions. The main lamp unit 95 includes a pair of main lamp sockets 954, a pair of main lamps 957, a positioning seat 952, and a lamp socket holder 953. Each main lamp 957 is mounted on a respective one of the main lamp sockets 954. The positioning seat 952 is formed with an upper plate portion 9521 seated on the upper end of the tubular sleeve 944, and a retaining post portion 9522 extending downwardly from the upper plate portion 9521 and insertingly retained in the tubular sleeve 944. The lamp socket holder 953 is mounted on the upper plate portion 9521. The wire unit 912 extends through the positioning seat 952 and the lamp socket holder 953 so as to connect with the main lamp sockets 954. The main lamp sockets 954 are retained in anchoring end portions 9531 of the lamp socket holder 953. The annular skirt member 96 is disposed to surround the upper plate portion 9521 of the positioning seat 952. The lampshade 97 is seated on the upper plate portion 9521 of the positioning seat 952, and is disposed to surround the lamp socket holder 953, thereby surrounding the main lamps 957.

A drawback of the conventional stand lamp assembly resides in that when the night lamp 942 is damaged or malfunctions, it is very difficult to replace the night lamp 942 since the tubular sleeve 944 has no opening in its peripheral wall. Since the tubular sleeve 944 has no opening, the main lamp unit 95 has to be disassembled first before the night lamp 942 can be removed.

SUMMARY OF THE INVENTION

Therefore, the main object of the present invention is to provide a stand lamp assembly that can facilitate replacement of a night lamp of an auxiliary lamp unit without disassembling the main lamp unit.

According to the present invention, a stand lamp assembly includes a stand frame unit, and auxiliary and main lamp units. The auxiliary lamp unit includes a night lamp disposed removably on a night lamp socket, a light sensor to control activation of the night lamp in accordance with ambient light conditions, and a sleeve disposed around the night lamp and having a rotatable cover body that can be opened to permit removal of the night lamp via an opening in the sleeve.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
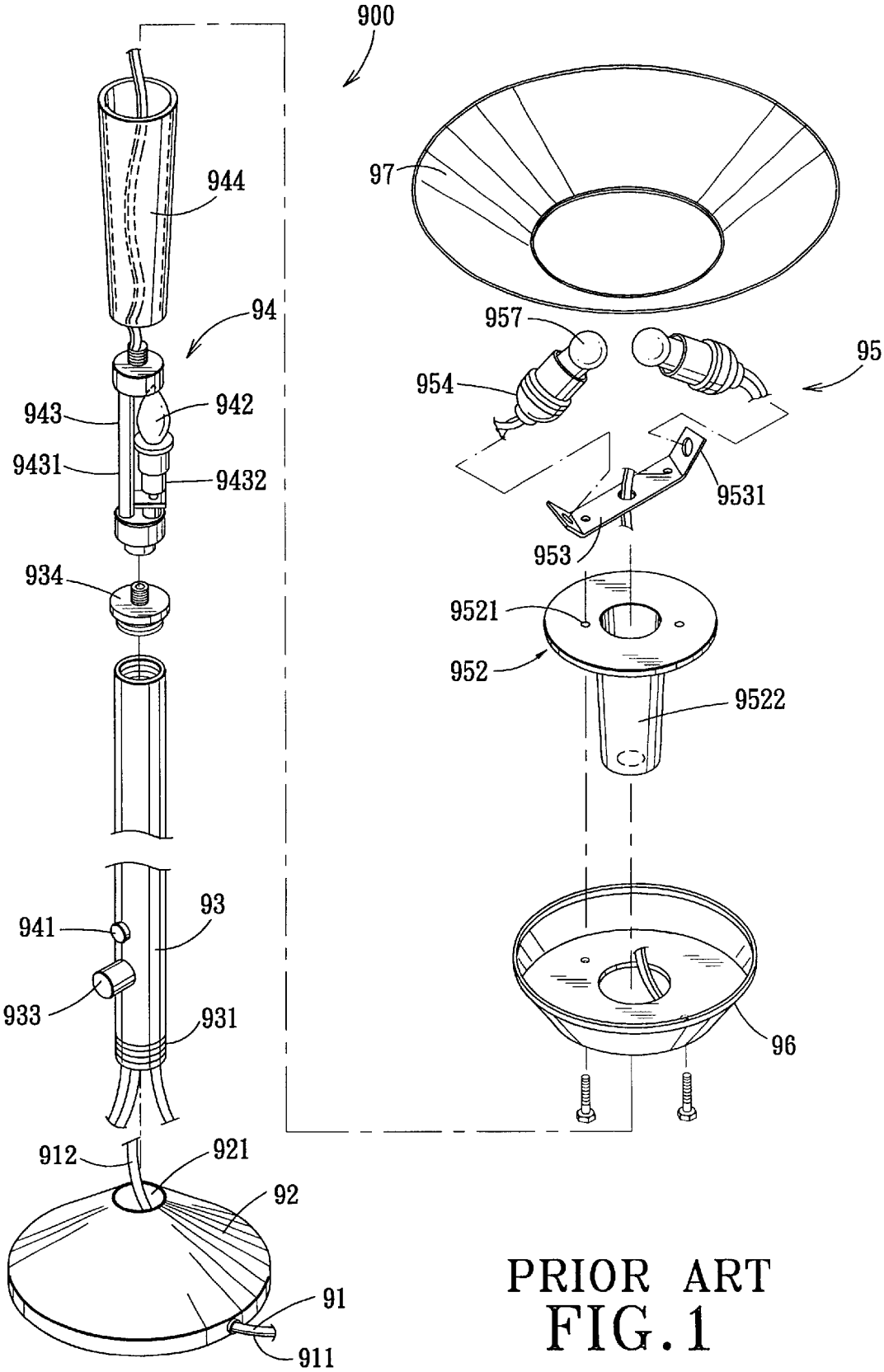
PRIOR ART FIG. 1
FIG. 1 is a partly exploded perspective view of a conventional stand lamp assembly.
Figure 2:
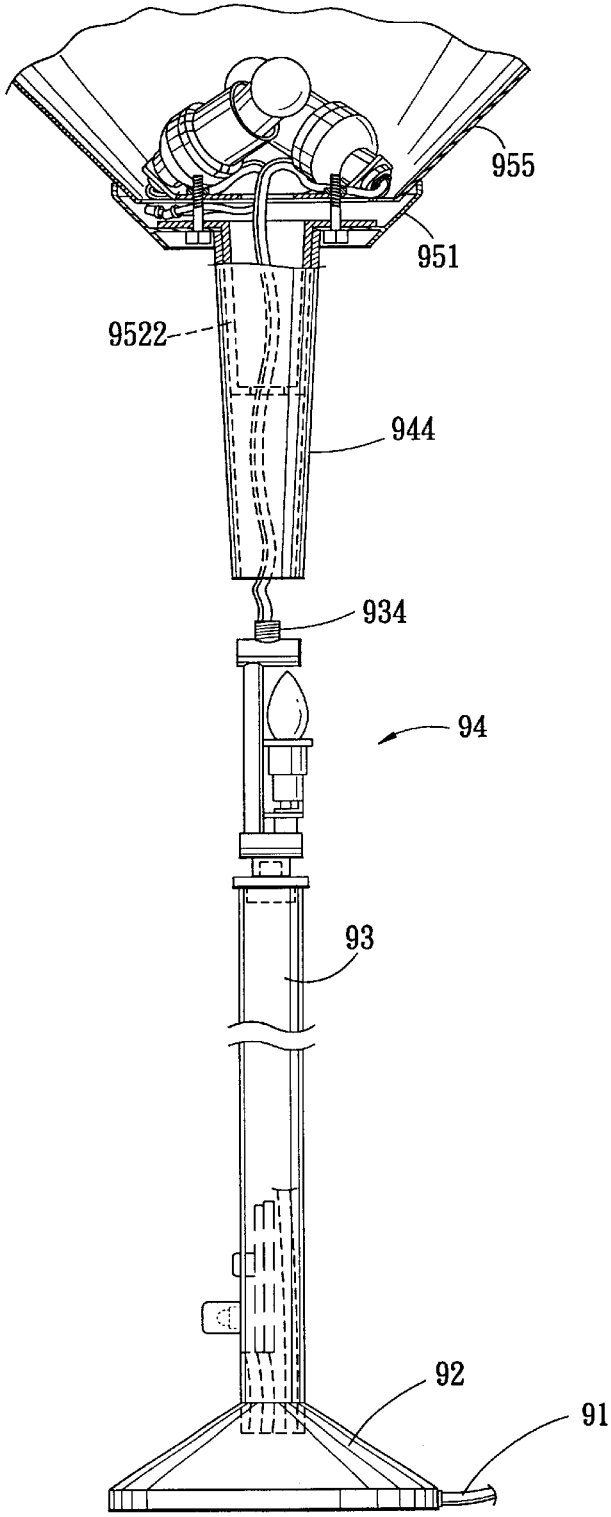
FIG. 2 PRIOR ART
FIG. 2 is a fragmentary partly sectional schematic view of the stand lamp assembly of FIG. 1 in an assembled state.
Figure 3:
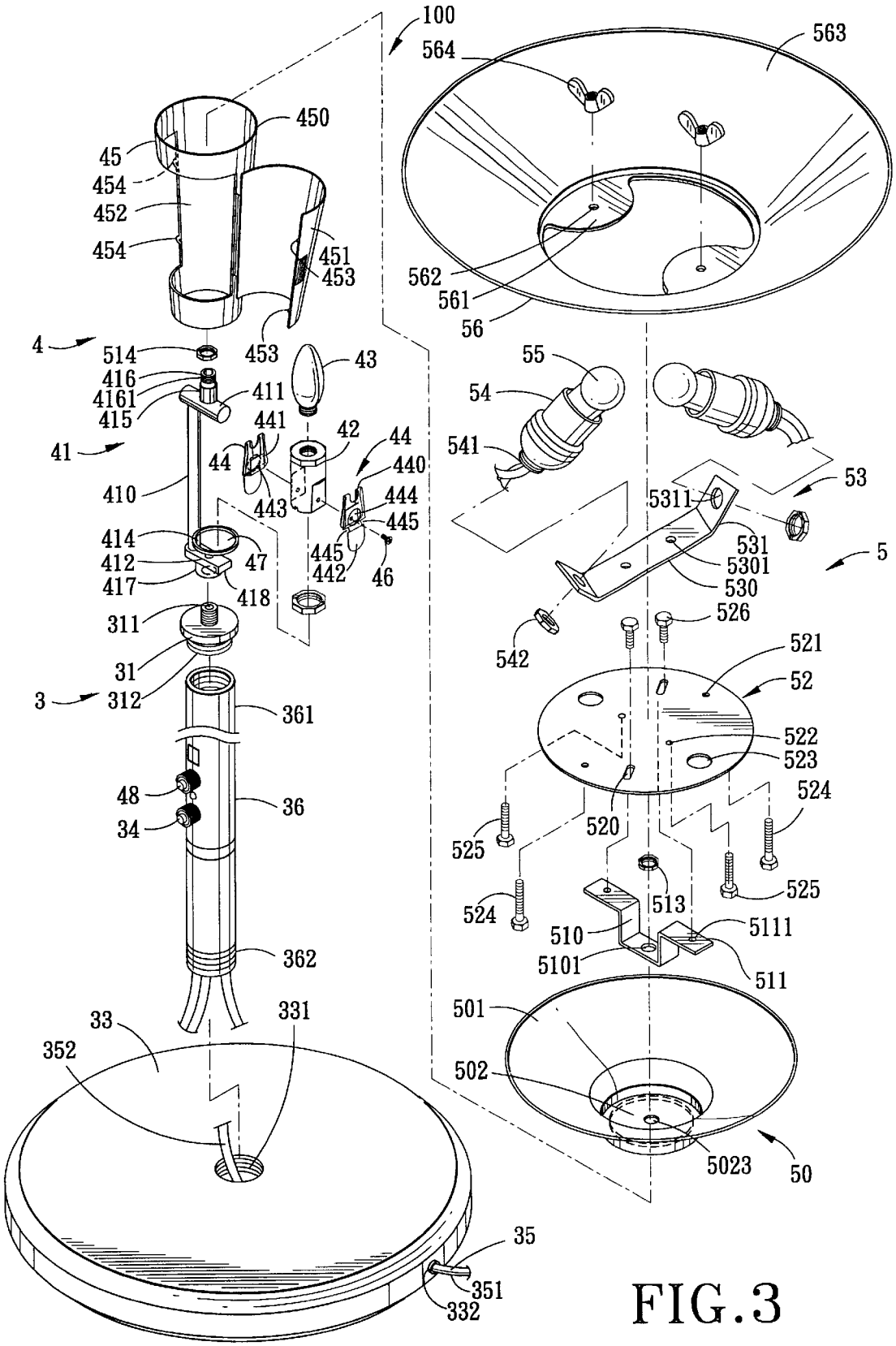
FIG. 3 is a partly exploded perspective view of the preferred embodiment of a stand lamp assembly according to the present invention.
Figure 4:
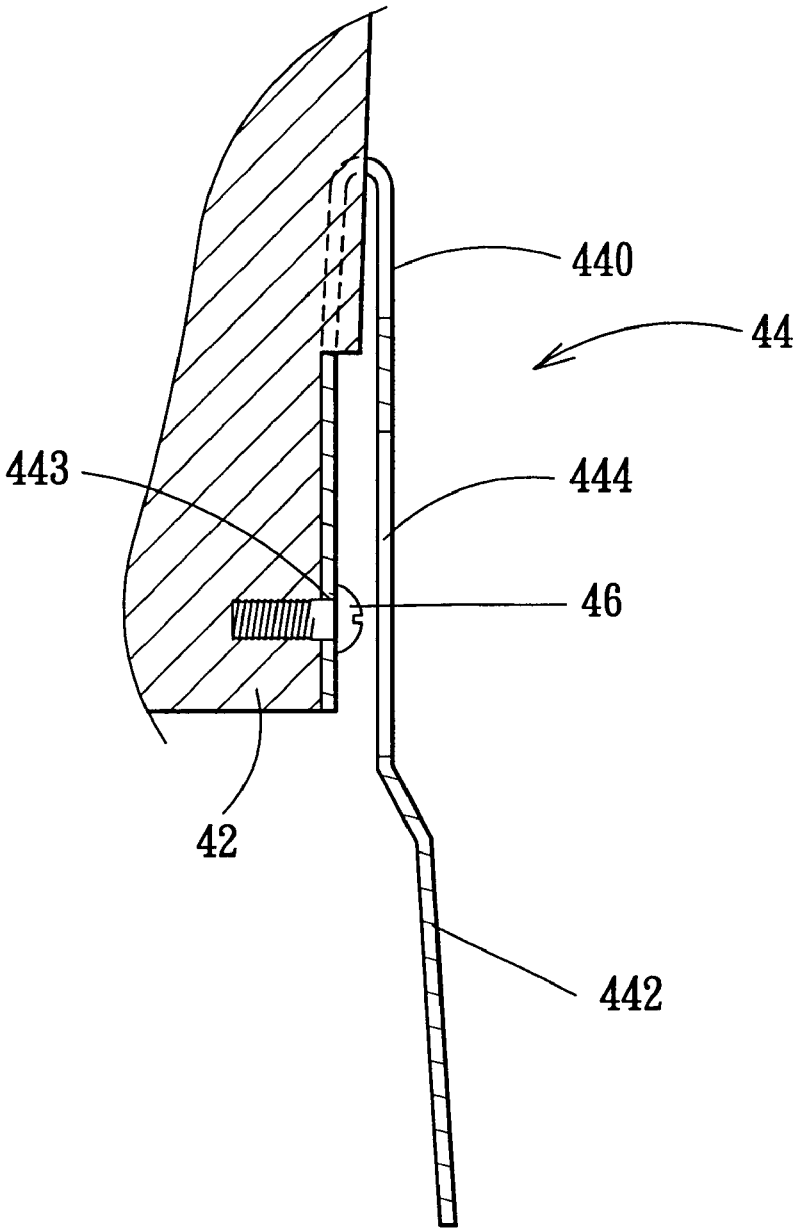
FIG. 4 is an enlarged sectional view of a resilient member that is mounted to a night lamp socket of the preferred embodiment.
Figure 5:
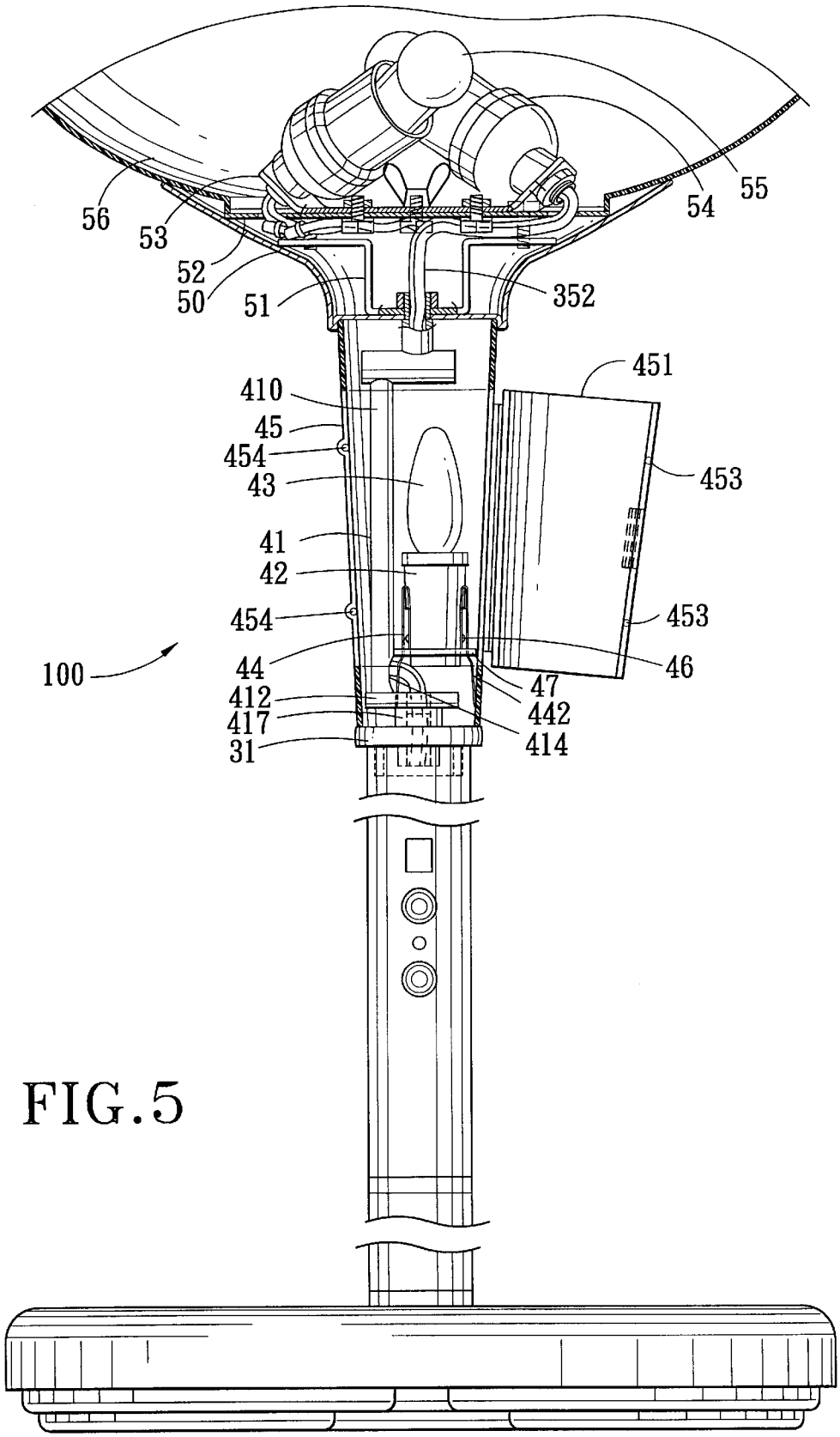
FIG. 5 is a fragmentary partly sectional schematic view of the preferred embodiment in an assembled state.

Referring to FIGS. 3 to 5, the preferred embodiment of a stand lamp assembly 100 according to the present invention is shown to comprise a stand frame unit 3, an auxiliary lamp unit 4, and a main lamp unit 5.

The stand frame unit 3 includes a stand base 33, a power control circuit 35, and an upright stand body 36. The stand base 33 has a weight and size sufficient to stably support the stand lamp assembly 100 on a ground surface, and has a center threaded hole 331 and a side hole 332.

The power control circuit 35 includes a power cord 351 and a wire unit 352. The power cord 351 extends outwardly from the side hole 332 and is terminated by plug member (not shown) for connection to an electrical outlet (not shown). The wire unit 352 extends outwardly from the center hole 331 to connect with the auxiliary and main lamp units 4, 5.

The upright stand body 36 has an externally threaded lower portion 362, and an upper portion 361 with an inner threaded wall opposite to the lower portion 362. The lower portion 362 is engaged threadedly to the central threaded hole 331, thereby securing the stand body 36 on the stand base 33. A power switch 34 is mounted on the upright stand body 36, is connected to the control circuit 35 in a known manner, and controls the activation of the main lamp unit 5.

The auxiliary lamp unit 4 includes an upright frame member 41, a night lamp socket 42, a night lamp 43, a tubular sleeve 45, an annular ring 47, and a light sensor 48. The upright frame member 41 is mounted threadedly on the upper portion 361 of the stand body 36, and has a left side formed with a hollow post 410, an inverted-T tube 415 connected fixedly to an upper end of the hollow post 410, and a T-shaped portion 412 connected fixedly to a lower end of the hollow post 410. The hollow post 410 is formed with a wire hole 414. The T-shaped portion 412 has a horizontal plate portion 418 connected to the hollow post 410, and a vertical tube portion 417 connected threadedly to the horizontal plate portion 418. The vertical tube portion 417 has an inner threaded hole extending through the horizontal plate portion 418, and engages the upper portion 361 of the upright stand body 36 by means of a connector 31. The connector 31 has an externally threaded upper end 311 that threadedly engages the vertical tube portion 417 of the T-shaped portion 412, and an externally threaded lower end 312 opposite to the upper end 311 and threadedly engaging the upper portion 361 of the stand body 36, thereby securing the upright frame member 41 on the upright stand body 36. The inverted-T tube 415 has a horizontal tube portion 411 and a vertical tube portion 416, which is connected fixedly to a middle portion of the horizontal tube portion 411 at a lower end and which is formed with an externally threaded upper end 4161. The wire unit 352 extends through the vertical tube portion 417 of the T-shaped portion 412, through the wire hole 414 in the hollow post 410, and through the horizontal and vertical tube portions 411, 416 of the inverted-T tube 415.

The ring 47 is disposed fixedly on the hollow post 410 above the wire hole 414, and is located around the night lamp socket 42.

The night lamp socket 42 is provided with a pair of resilient members 44 attached respectively to two opposite sides of the night lamp socket 42. Each resilient member 44 includes an inverted U-shaped mounting element 440 (see FIG. 4) that has upright inner and outer plate portions, and an inclined push plate 442 extending outwardly, downwardly, and integrally from a lower end of the outer plate portion of the mounting element 440 (see FIG. 4). The mounting element 440 is formed with a front through hole 444 in the outer plate portion, and a rear rivet hole 443 in the inner plate portion. During assembly of each resilient member 44 and the night lamp socket 42, a rivet 46 is inserted into the rivet hole 443 and the night lamp socket 42 via the through hole 444. Two notches 445 are formed between the mounting element 440 and the push plate 442. The resilient members 44 are inserted into and pressed outwardly against the ring 47 in such a manner that the ring 47 engages the notches 445 in the resilient members 44 so as to position the night lamp socket 42 within the ring 47.

The night lamp 43 is disposed removably on the night lamp socket 42.

The sleeve 45 is tapered, is made of a light transmissive material, is sleeved on the upright frame member 41, and has a lower end that is seated on the connector 31, and an upper end that is mounted with the main lamp unit 5. The sleeve 45 has a peripheral wall 450 with an opening 452, and a curved cover body 451 connected rotatably to the peripheral wall 450. The cover body 451 has a free end formed with a pair of fixed pins 453, and is rotatable to a closed position so as to cover the opening 452, and an open position so as to permit removal of the night lamp 43 and the night lamp socket 42 via the opening 452, as shown in FIG. 5. The peripheral wall 450 is formed with a pair of pin recesses 454, which have a semi-circular cross-section and which engage respectively and fittingly the pins 453 of the cover body 451 so as to retain the cover body 451 at the closed position.

The light sensor 48 is connected to the night lamp 43 so as to control activation of the night lamp 43 in accordance with ambient light conditions.

The main lamp unit 5 is mounted on the tubular sleeve 45, and includes an annular skirt member 50, a U-shaped positioning seat 510, upper and lower nuts 513, 514, two horizontal support plates 511, a horizontal positioning plate 52, a lamp socket holder 53, a pair of main lamp sockets 54, and a pair of main lamps 55. The annular skirt member 50 has a tapered upper portion 501 with an open end, and a bottom wall 502 connected integrally to the upper portion 501 and formed with a hole 5023 therethrough. The U-shaped positioning seat 510 abuts against the bottom wall 502, and is formed with a hole 5101 therethrough. The lower nut 514 is located under and abuts against the bottom wall 502. The upper nut 513 is located over and abuts against the positioning seat 510. The externally threaded upper end 4161 of the inverted-T tube 415 extends through the holes 5023, 5101 in the bottom wall 502 of the annular skirt member 50 and the positioning seat 510, and engages the upper and lower nuts 513, 514 so as to clamp the annular skirt member 50 and the positioning seat 510 between the upper and lower nuts 513, 514, thereby fixing the annular skirt member 50 and the positioning seat 510 relative to the upright frame member 41.

The horizontal support plates 511 are spaced apart from each other, and are formed integrally with the positioning seat 510. Each support plate 511 is formed with a threaded hole 5111. The horizontal positioning plate 52 is a thin circular plate, and is disposed above and mounted on top of the support plates 511. The positioning plate 52 is formed with a pair of diametrically opposed oval holes 520, a pair of diametrically opposed threaded holes 521, a pair of diametrically opposed through holes 522, and a pair of diametrically opposed wire holes 523. The lamp socket holder 53 is mounted on top of the positioning plate 52, and has an elongated portion 530 and two anchoring end portions 531. The elongated portion 530 has a pair of threaded holes 5301 that correspond to the through holes 522 in the positioning plate 52. Each anchoring end portion 531 is formed with a retaining hole 5311. Each of the main lamp sockets 54 is mounted threadedly on a respective one of the anchoring end portions 531 of the lamp socket holder 53. Each main lamp 55 is mounted threadedly on a respective one of the main lamp sockets 54.

The stand lamp assembly 100 further comprises a lampshade 56 having a tapered upper portion 563 with an open end, and a bottom portion formed integrally with a pair of horizontal lugs 561 that are mounted on top of the positioning plate 52. Each of the horizontal lugs 561 is formed with a hole 562.

During assembly, the resilient members 44 are fastened to the night lamp socket 42 by the rivets 46 (only one is shown in FIG. 3), and the night lamp 43 is threadedly secured on the night lamp socket 42. The night lamp socket 42 is then inserted into the ring 413 by pressing the two push plates 442 into the ring 47 until the ring 47 engages the notches 445. The assembly of the night lamp socket 42 and the night lamp 43 is now positioned within the ring 47. The upright frame member 41 is then brought into engagement with the stand body 36 by inter-engaging the upright frame member 41 and the connector 31, and the sleeve 45 is sleeved on the upright frame member 41. The externally threaded upper end 4161 of the inverted-T tube 415 of the upright frame member 41 protrudes out of the sleeve 45 at this time. The auxiliary lamp unit 4 is now mounted securely on the stand frame unit 3.

The next step is to secure the positioning seat 510 and the annular skirt member 50 on the externally threaded upper end 4161 of the upright frame member 41 by threadedly engaging the upper and lower nuts 513, 514 with the externally threaded upper end 4161. Then, the lamp socket holder 53 is secured on the positioning plate 52 by means of a pair of screw bolts 525, each of which extends upwardly through a respective one of the through holes 522 in the positioning plate 52, and engages a respective one of the threaded holes 5301 in the lamp socket holder 53. Another pair of screw bolts 524 are engaged to and extend out of the threaded holes 521 in the positioning plate 52 for later engagement with the lampshade 56. The positioning plate 52 is then engaged to the horizontal support plates 511 by means of a pair of screw bolts 526 that extend downwardly from the oval holes 520 in the positioning plate 52 and that engage the threaded holes 5111 in the support plates 511. After the main lamps 55 are respectively and threadedly secured on the main lamp sockets 54, the main lamp sockets 54 are retained on the anchoring end portions 531 of the lamp socket holder 53 by engaging a pair of screw nuts 542 (only one is shown in FIG. 3) with threaded ends 541 of the main lamp sockets 54.

Finally, the lampshade 56 is mounted on the top surface of the positioning plate 52 by inserting the screw bolts 524 through the holes 562 in the horizontal lugs 561, and is secured on the positioning plate 52 by means of a pair of wing nuts 564 that engage the screw bolts 524.

Figure 6:
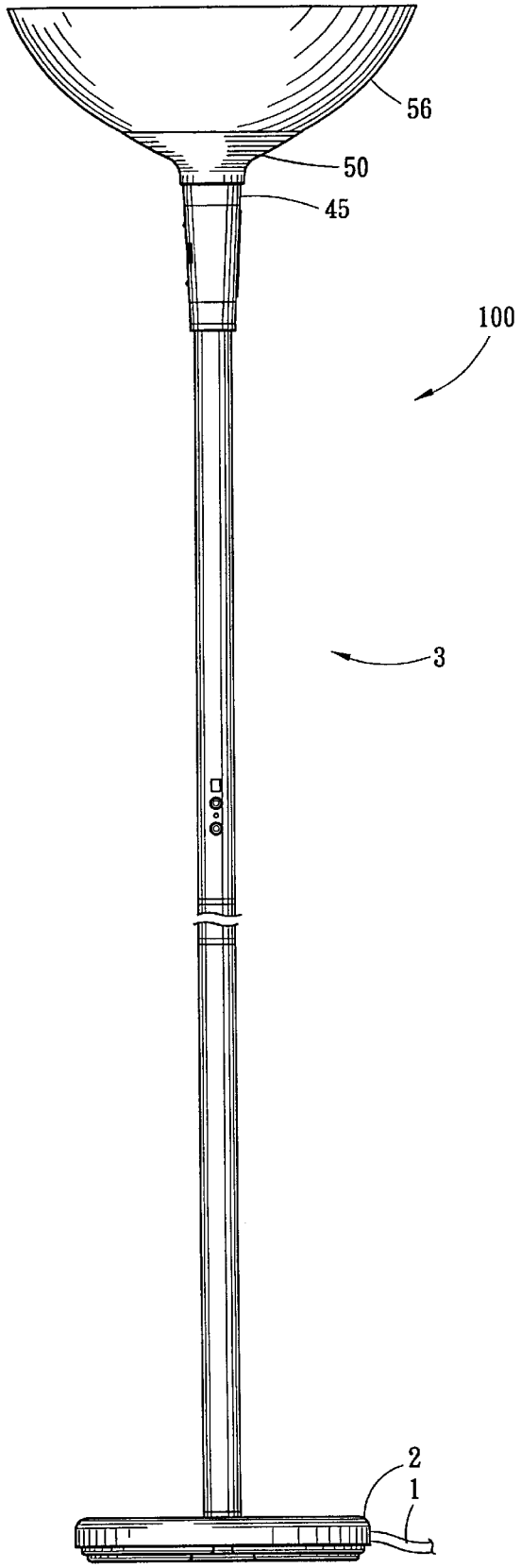
FIG. 6 is a side view of the preferred embodiment.

The wire unit 352 extends from the stand base 33 through the stand body 36, through the connector 31, through the upright frame member 41, through the hole 5023 in the annular skirt member 50, through the hole 5101 in the positioning seat 510, and out of the wire holes 523 in the positioning plate 52 to connect with the terminals (not shown) of the main lamp sockets 54. The stand lamp assembly 100 is now fully assembled and is best illustrated in FIG. 6.

It is noted that the stand base 33 of the stand lamp assembly 100 of the present invention can be omitted. In this case, the stand body 36 can be directly fixed on a piece of furniture.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A stand lamp assembly comprising:

a stand frame unit including an upright stand body having an upper portion;

an auxiliary lamp unit including an upright frame member mounted on said upper portion of said stand body, a night lamp socket mounted on said frame member, a night lamp disposed removably on said night lamp socket, a light sensor connected to said night lamp so as to control activation of said night lamp in accordance with ambient light conditions, and a sleeve made of a light transmissive material, said sleeve being sleeved on said upright frame member, and having a peripheral wall with an opening, and a cover body connected rotatably to said peripheral wall, said cover body being rotatable to a closed position so as to cover said opening, and an open position so as to permit removal of said night lamp from said night lamp socket via said opening; and a main lamp unit mounted on said sleeve.

2. The stand lamp assembly as claimed in claim 1, further comprising a power switch mounted on said stand frame unit and connected to said main lamp unit to control activation of said main lamp unit.

3. The stand lamp assembly as claimed in claim 1, wherein said auxiliary lamp unit further includes a ring disposed fixedly on said upper portion of said stand body, said night lamp socket being provided with a pair of resilient members attached respectively to two opposite sides of said night lamp socket, said resilient members being inserted into and pressing outwardly against said ring so as to position said night lamp socket within said ring.

4. The stand lamp assembly as claimed in claim 3, wherein said cover body of said sleeve has a free end formed with a fixed pin, said peripheral wall of said sleeve being formed with a pin recess that has a semi-circular cross-section and that engages fittingly said pin so as to retain said cover body at the closed position.

5. The stand lamp assembly as claimed in claim 4, wherein said main lamp unit includes an annular skirt member with a bottom wall that is formed with a hole therethrough, a U-shaped positioning seat that abuts against said bottom wall and that is formed with a hole therethrough, a lower nut that is located under and that abuts against said bottom wall of said annular skirt member, and an upper nut that is located over and that abuts against said positioning seat, said upright frame member of said auxiliary lamp unit including an inverted-T tube having a horizontal tube portion and a vertical tube portion, which is connected fixedly to a middle portion of said horizontal tube portion at a lower end and which is formed with an externally threaded end that extends through said holes in said annular skirt member and said positioning seat and that engages said upper and lower nuts so as to clamp said annular skirt member and said positioning seat between said lower and upper nuts, thereby fixing said annular skirt member and said positioning seat relative to said upright frame member.

6. The stand lamp assembly of claim 4, wherein said main lamp unit includes:

two horizontal support plates spaced apart from each other and formed integrally with said positioning seat;

a horizontal positioning plate disposed above and mounted on top of said support plates;

a lamp socket holder mounted on top of said positioning plate;

a main lamp socket mounted on said holder; and a main lamp mounted on said main lamp socket.

7. The stand lamp assembly as claimed in claim 6, further comprising a lampshade having a bottom portion formed integrally with a pair of horizontal lugs that are mounted on said positioning plate.

* * * * *